US008770419B2

(12) United States Patent
Carlton

(10) Patent No.: US 8,770,419 B2
(45) Date of Patent: Jul. 8, 2014

(54) ROTATABLE MULTILEVEL TOOL ORGANIZER

(76) Inventor: Craig P. Carlton, Quartz Hill, CA (US)

( * ) Notice: Subject to any disclaimer, the term of this patent is extended or adjusted under 35 U.S.C. 154(b) by 0 days.

(21) Appl. No.: 13/494,968

(22) Filed: Jun. 12, 2012

(65) Prior Publication Data

US 2013/0328467 A1 Dec. 12, 2013

(51) Int. Cl.

| | |
|---|---|
| ***A47F 7/00*** | (2006.01) |
| ***A47F 5/02*** | (2006.01) |
| ***B25H 3/02*** | (2006.01) |
| ***B25H 3/04*** | (2006.01) |

(52) U.S. Cl.

CPC ..... *A47F 7/0028* (2013.01); *A47F 5/02* (2013.01); *B25H 3/025* (2013.01); *B25H 3/04* (2013.01)

USPC ..... 211/70.6; 211/69; 211/70

(58) Field of Classification Search

CPC ..... B25H 3/006; B25H 3/00; B25H 3/003; B25H 3/02; B25H 3/025; B25H 3/04; B25H 3/06; B65D 85/20; B65D 85/28; B65D 85/08; B65D 1/34; B65D 1/36; A47F 7/0028; A47F 7/0035; A47F 7/0021; A47F 7/00; A47F 5/02; A47F 5/05; A47G 21/14; A47B 8/005; A47B 49/00; A47B 49/004

USPC ..... 211/70.6, 70, 78, 10, 60.1, 131.1, 211/129.1, 126.2, 69.1, 69, 163, 65, 77, 211/85.18; 206/349, 362, 371, 372, 373, 206/443, 446, 557, 558, 562, 564

See application file for complete search history.

(56) References Cited

U.S. PATENT DOCUMENTS

| | | | | | |
|---|---|---|---|---|---|
| 3,367,483 | A | * | 2/1968 | Studen | 206/379 |
| 3,489,289 | A | * | 1/1970 | Scott-Fenton | 211/78 |
| 3,696,920 | A | * | 10/1972 | Lahay | 206/370 |
| 4,126,366 | A | * | 11/1978 | Handler et al. | 312/249.2 |
| 4,240,684 | A | * | 12/1980 | Henning | 312/202 |
| 4,305,511 | A | * | 12/1981 | Denholtz | 211/70 |
| 4,460,085 | A | | 7/1984 | Jantzen | |
| D279,950 | S | * | 8/1985 | Wan | D7/640 |
| 4,573,574 | A | * | 3/1986 | Connery | 206/726 |
| 4,667,822 | A | | 5/1987 | Coopmans | |
| 4,826,007 | A | * | 5/1989 | Skeie | 206/373 |
| 4,901,846 | A | * | 2/1990 | Lehman | 206/1.8 |
| D310,749 | S | | 9/1990 | Ancona et al. | |
| 4,953,696 | A | * | 9/1990 | Huang et al. | 206/214 |
| 5,009,336 | A | * | 4/1991 | Liaw | 211/69.1 |
| 5,188,242 | A | * | 2/1993 | Smith | 211/69 |
| D354,989 | S | * | 1/1995 | West | D19/85 |
| 5,377,850 | A | * | 1/1995 | Liaw | 211/163 |
| 5,379,885 | A | * | 1/1995 | Chen | 206/216 |
| 5,588,659 | A | | 12/1996 | Boes et al. | |
| 5,641,080 | A | * | 6/1997 | Humphrey et al. | 211/77 |
| 5,669,498 | A | * | 9/1997 | Fierek et al. | 206/373 |

(Continued)

*Primary Examiner* — Jennifer E Novosad

(57) ABSTRACT

A rotatable multilevel tool organizer for storing and presenting a variety of tools. The tool organizer includes a base unit that rests on a lazy susan bearing, allowing 360 degree rotation. The base unit has a plurality of drawers or swing out compartments. The tool organizer includes a plurality of cylindrical shaped pieces on the top of the base unit to hold mechanics sockets or other components. The tool organizer includes a middle unit resting on the base unit that holds tools in the vertical position. The tool organizer includes an upper unit resting on the base unit for storing and presenting longer handle tools in the vertical position.

6 Claims, 7 Drawing Sheets

(56) References Cited

U.S. PATENT DOCUMENTS

| | | | | |
|---|---|---|---|---|
| 5,894,944 | A * | 4/1999 | Swift | 211/78 |
| D426,062 | S | 6/2000 | Shang | |
| 6,105,768 | A | 8/2000 | Brown | |
| 6,206,493 | B1 * | 3/2001 | Sanchez-Levin et al. | 312/125 |
| D481,869 | S | 11/2003 | Chan | |
| D493,284 | S | 7/2004 | Lee | |
| 6,905,020 | B2 * | 6/2005 | Chang | 206/373 |
| 7,225,633 | B2 * | 6/2007 | DeMars | 62/457.6 |
| 7,584,973 | B2 | 9/2009 | Brager | |
| 7,717,277 | B2 | 5/2010 | Meinhardt | |
| D650,862 | S * | 12/2011 | Chuang | D19/77 |
| 2004/0188293 | A1 | 9/2004 | Lee | |
| 2004/0226841 | A1 | 11/2004 | Ginder | |
| 2005/0140062 | A1 | 6/2005 | Chang | |

* cited by examiner

FIGURE 3.1

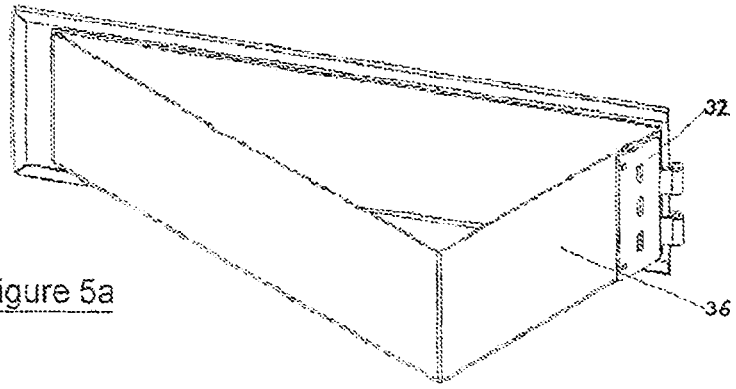
Figure 5a
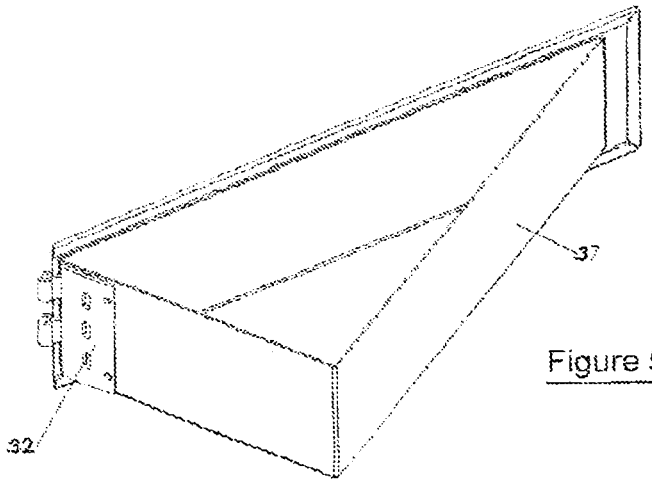
Figure 5b
FIGURE 5

Figure 7a
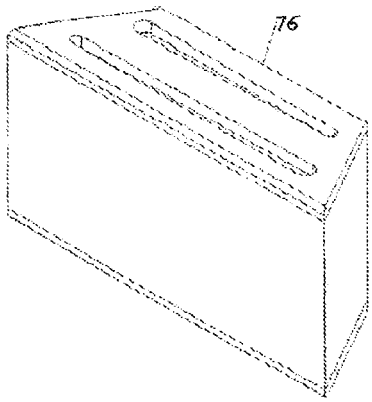
Figure 7b
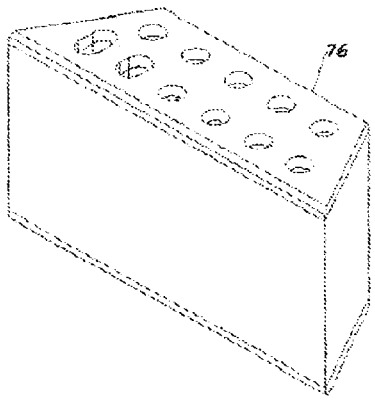
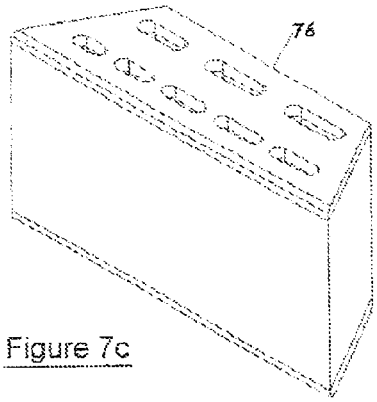
Figure 7c
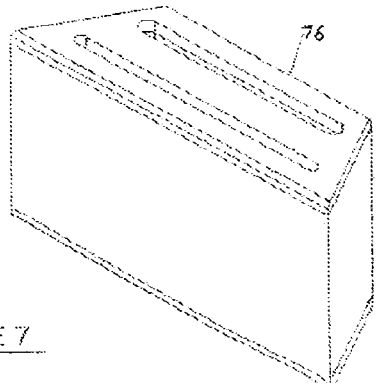
Figure 7d
FIGURE 7

ROTATABLE MULTILEVEL TOOL ORGANIZER

BACKGROUND OF THE INVENTION

The present invention relates to tool storage devices and to organizing tools for ease of use and instant access or recognition of said tools.

SUMMARY OF THE PRESENT INVENTION

In the present invention embodiment, I presently contemplate all components to be manufactured of carbon steel and polyethylene foam. The lazy susan bearing and drawer slides are standard of the industry materials commonly found in household or light industrial components. However, I can envision modifying the configuration of the middle unit and top unit to include larger or small openings for varying tool configurations. I can also envision manufacturing the present invention using different materials, such as, injection molded plastic, aluminum, stainless steel, titanium or carbon fiber. I envision using a different type of foam for the foam insert, including but not limited to memory foam, polyester foam or perhaps a spray foam injection method. I envision the present invention where the lazy susan bearing will not be used. The unit could be placed on an existing rotating device or perhaps rotation is not required because of full access from all sides.

The present invention can take on multiple embodiments. First embodiment, being what is presented in FIGS. 1 through 10. In this embodiment, the present invention is of a hexagon geometric shape with the lower unit, middle unit and top unit all being of the same geometric shape but being of different dimension in the horizontal plane. The lower unit having a plurality of drawers or compartments that slide or swing out for full access to components, tools or supplies stored within the drawer or compartment. In another embodiment, I envision the present invention to be of a different geometric shape, while still maintaining the most efficient use of the available space and surfaces, which was not fully accomplished in the previous art. In this embodiment the present invention could be placed on a horizontal surface and used to store and organize traditional mechanics tools such as wrenches, sockets, screwdrivers, hammers, long socket extensions and a multitude of other tools normally used by a mechanic and have full access to all storage surfaces of the unit by rotation of the unit.

In another embodiment, utilizing the base unit and lazy susan bearing and modifying the configuration of the plurality of openings in the middle unit and top unit, the present invention could be utilized to store and organize tooling for computer numerical control machines. This would allow the machine operator easy access to the tools, provide a method of organizing the tools for sequencing operations and ensure tools are accounted for upon completion of the project.

In another embodiment, utilizing the present invention with a lazy susan bearing and changing the configuration of the plurality of the openings in the middle unit and top unit, the present invention can be used for storing and organizing hobbyist tools or components, including art supplies, gardening tools or supplies and specialty tools.

In all cases of embodiment, the present invention can be fabricated by one skilled in the field, using general knowledge and standard fabrication practices. With minor modifications to the plurality of openings and configuration of the middle and top units the present invention can take on multiple embodiments and still stay within the intent of this patent specification.

DESCRIPTION OF PRIOR ART

The use of tool organizers or tool storage devices is known in the prior art. Most hold a variety of tools in varying configurations and designs, comprising a variety of chambers, compartments and receiving devises. For example, prior art is described in U.S. Pat. No. 7,717,277 Meinhardt and U.S. Pat. No. 3,489,289. While both are rotatable, they sacrifice tool platform structure by using multiple flat shelves and sloped surfaces for Meinhardt. In another prior art by Scott-Fenton the device includes a significant number of pockets to hold fastening members, parts, washers, screws and nails, but not the ability to hold a significant plurality of tools. Both holders use a generally circular format that sacrifices storage platform organization space. Both holders have a rotatable base or lazy susan type structure. The Scott-Fenton has no drawers and the Meinhardt has only one central drawer.

The present invention departs from the conventional concept of the prior art by providing a more organized method for storing and presenting tools or other components and adding swing out devices for tool or other component storage. The present invention utilized a plurality of vertical cylindrical devices to hold standard sockets. The advantage of this configuration is the physical diameter of the socket is not limited by the size of an opening or hole, as is the case in Meinhardt. The present invention includes a pullout drawer and utilizes all available space including the interior portion of the upper unit, for long handle tools or components, like hammers, tool extensions, socket wrenches, that are stored or rest in the upper unit. It is the object of the present invention to utilize a lazy susan type ball bearing for a 360 degree rotation and full access to all surfaces. It is the object of the present invention such that, it is efficient to use, allowing full access and visibility to all tools, minimizing unused space and can be placed on a standard horizontal surface or on a rolling device for ease of use within the work area. It is the object of the present invention to be easier and more efficient to manufacture than previous art, by utilizing industry standard fabrication practices and industry standard materials, not requiring special materials, tools, methods or skills.

Thus several advantages of the present invention are, the method of storing tools or components in the vertical position through the use of foam inserts and cylindrical pieces. Having the tools or components securely held in place minimizes the possibility of the tools or components falling off the tool organizer during the use. Other advantages of one or more aspects of the present invention are that the rotatable multilevel tool organizer allows for a more variety and types of tools or components of varying sizes to be stored or presented.

BRIEF DESCRIPTION OF THE DRAWINGS

Reference will now be made in detail to the presently preferred embodiments of the invention, examples of which are illustrated in the accompanying drawings. Throughout the following detailed description, the same reference numerals refer to the same elements in all figures.

FIG. 5 illustrates an exploded view of a rotatable multilevel tool organizer swing out compartment with hinge leaf right hand configuration FIG. 5*a* and left hand configuration FIG. 5*b*

FIG. 7 illustrates an exploded view of a rotatable multilevel tool organizer foam insert for multitier upper unit in FIGS. 7*a*, 7*b*, 7*c*, and 7*d*

Referring to FIG. 2, a perspective view of the multitier upper unit 70 in a fully assembled configuration and shown without tools. Various shaped openings in the horizontal surface of the middle unit 70 allow for storage of a plurality of tools. In FIG. 2 the foam insert 76 can be viewed with a plurality of openings with varying shapes and sizes. This allows for a more versatile use of the invention. Also in this perspective, the multitier upper unit 70 is also shown with a horizontal surface 94 with a plurality of openings with varying shapes and sizes. This allows for a more versatile use of the invention. The foam insert 98 can be observed, showing the alignment of the plurality of openings in the foam insert 98 with the plurality of openings in the horizontal surface 94 of the multitier upper unit 70.

Referring to FIG. 3.1, this is a horizontal cross section through FIG. 3 in architectural plan view. The view provides a visual layout of the dividers to support the ball bearing drawer slides 26 as they relate to the location of the drawer compartment 42 and the location of the ball bearing drawer slides 44. FIG. 3.1 also provides a view of the vertical divider to support hinge 28 and the location of the hinge 32 as it is mounted on the vertical divider to support hinge 28. FIG. 3.1 also provides a view of the lower horizontal surface 22 of the base unit 20 with the locations for the slots for finger hold 46.

Referring to FIG. 4, this is an exploded view of the dividers to support the ball bearing drawer slides 26 and dividers to support hinges 32. The view shows the shape of the dividers to support the ball bearing slides 26 and the divider to support the hinges 28 consisting of bent flanges along the longest side, of which will be used for structural support and for solidly connecting the dividers to the upper horizontal surface 24 of the base unit 20 and the lower horizontal surface 22 of the base unit 20, using a welding method or other permanently connected method. Additionally, the view shows a plurality of openings for the intended use of efficiently attaching the ball bearing drawer slides 44. The openings are of a similar configuration and alignment as the mounting holes on the ball bearing drawer slides 44. On the vertical divider to support hinge 28, there are a plurality of openings that are intended to be used for critical alignment, in the horizontal plane and vertical plane, of the hinge 32 to the divider to support hinge 28, during final assembly.

Referring to FIG. 5, this is an exploded view of the swing out storage compartment 36 and the reverse swing out storage compartment 37. Each view includes one leaf of the hinge 32 attached in the final position. This view is intended to show the swing out storage compartment 36 with one leaf of the hinge 32. Because of the geometrical configuration of the present invention, a reverse swing out storage compartment 37 is included. The reverse swing out storage compartment 37 is of the same geometric shape and configuration, is capable of storing a plurality of tools or other components. The swing out storage compartment 36 and the reverse swing out storage compartment 37 include a plurality of openings for alignment and ease of installation of the hinge 32 during final assembly.

Referring to FIG. 6, this is an exploded view of the drawer compartment 42. This view is intended to show the drawer compartment 42 including the ball bearing drawer slides 44 as they are attached. In another embodiment of the present invention, a plurality of drawers may be included.

Referring to FIG. 7, this is an exploded view of the foam inserts for the multitier upper unit 70. This view of the foam insert 76 shows a plurality of geometrically shaped openings in which tools or other components can be stored and organized in the vertical position. This allows the user of the present invention to easily recognize and have access to the tools or components. In other embodiments, the plurality of openings may be of different geometric shapes to accommodate a variety of tools or components.

Referring to FIG. 8, this is an exploded view of the foam insert. The plurality of openings in the top unit horizontal surface 94 and the foam insert 98 allow for a plurality of tools or components to be stored or organized, allowing the user of the present invention to easily recognize and have access to the tools or components. In other embodiments, the plurality of openings in the top unit horizontal surface 94 and foam insert 98 may be of different geometric shapes or configurations to accommodate a variety of tools or components.

Referring to FIG. 9, this is an exploded view of the hinge 32. This view shows the hinge 32 in a semi open position with all three leafs. On each leaf, there are a plurality of openings that are used for alignment during assembly. The other plurality of openings are used for permanently attaching the hinge 32 to the vertical divider to support hinge and to the swing out storage compartment 36 and the swing out storage compartment 37 using a welding method or mechanical fastener method. In other embodiments, the hinge 32 may be changed or modified to accommodate a plurality of storage compartments.

Referring to FIG. 10, this is a perspective view of the base unit 20 and middle unit 100. This view shows a middle unit 100 with a plurality of openings in the horizontal surface of the middle unit 100 for storage of computer numerical control tooling or other similar type components. The middle unit 100 is securely fastened to the base unit 20 and the assembly rests on a lazy susan bearing unit 56 for a full 360 degree rotation. In other embodiments of the present invention, the middle unit 100 may be modified or reconfigured to accommodate a plurality of tools of different shapes or sizes.

DESCRIPTION OF PRIOR ART

Figure 1:
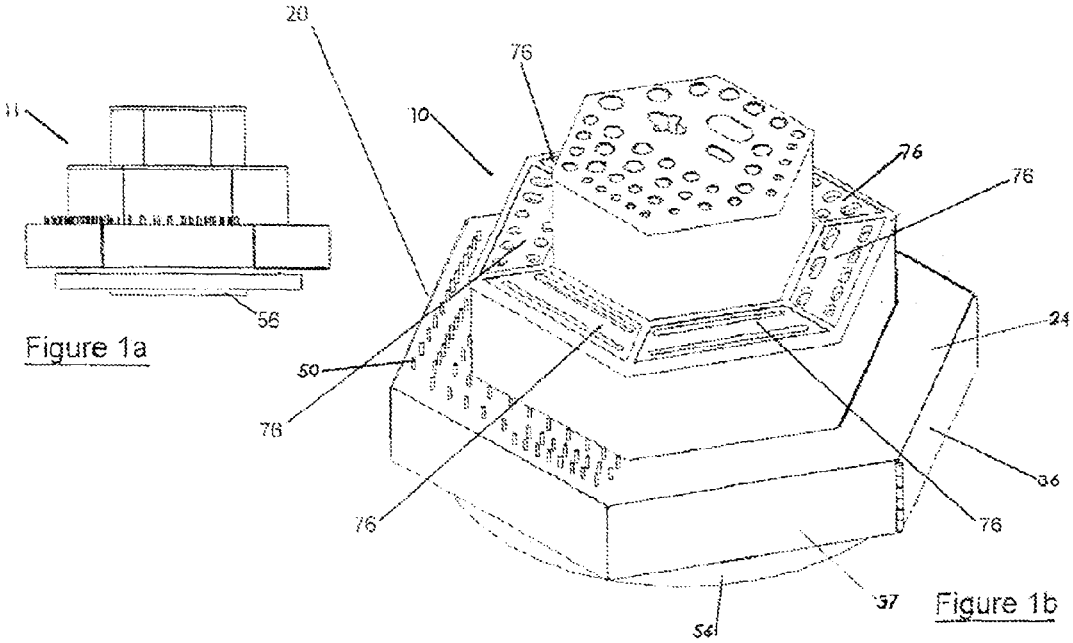
FIG. 1 illustrates a perspective view FIG. 1*b* and elevation view FIG. 1*a* of a rotatable multilevel tool organizer without tools
Figure 2:
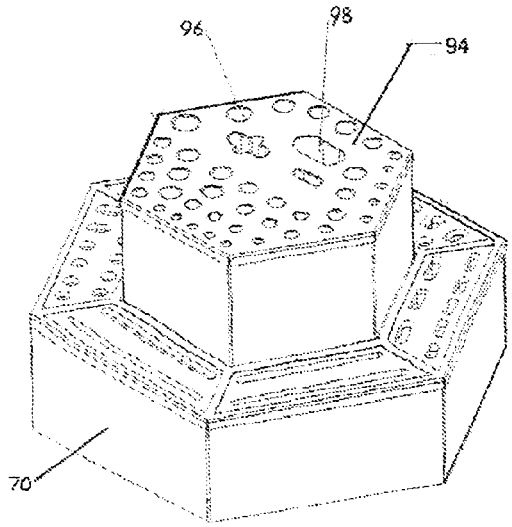
FIG. 2 illustrates a perspective view of a rotatable multilevel tool organizer multitier upper unit assembled without tools FIG. 3 and FIG. 3.1 illustrates an exploded view of a rotatable multilevel tool organizer base unit showing dividers and drawer slides and hinges
Figure 3:
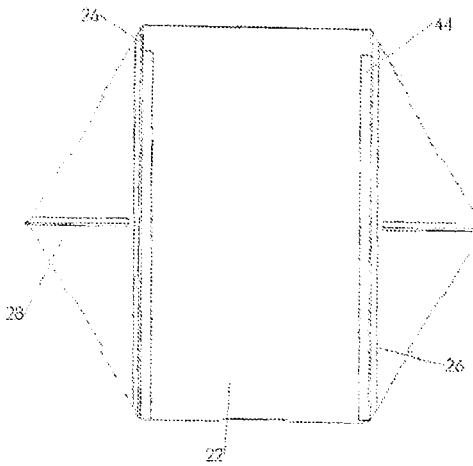
Referring to FIG. 3 this is an exploded view of the base unit 20 showing a plurality of dividers, drawer compartment 42, ball bearing drawer slides 44 and hinges 32. The base unit 20 consists of a lower horizontal surface 22, an upper horizontal surface 24, dividers to support the ball bearing drawer slides 44, dividers to support hinges 32. The dividers to support the ball bearing drawer slides 44 and dividers to support hinges 32, provide structural support to the upper horizontal surface 24 of the base unit 20, and multitier upper unit 70. Below the base unit 20, resides a lazy susan bearing unit 56. The lazy susan bearing unit 56 is of substantial configuration to support the weight of the rotatable multilevel tool organizer 10 and a plurality of tools and components. The ball bearing drawer slides 44 are of substantial configuration to support the weight of a plurality of tools or components and provide full access to the components stored within the drawer compartment 42. The ball bearing drawer slides 44 are a type that would be used on a standard drawer found in a household or light industrial application. There are a plurality of dividers 28 configured in the vertical position to support hinges 32. These dividers 28 are configured to ensure the alignment of the hinge pin to allow for the full movement of the swing out storage compartments 36. The hinges 32 consist of three leafs and a single pin configuration. One of the leafs is solidly attached to the vertical divider 28, another is solidly attached to a swing out compartment 36 and the third is solidly attached to a swing out compartment 37. Also shown in this view is the magnet 48. The plurality of magnets 48 are permanently attached to the vertical divider to support the ball bearing drawer slide 26. The magnet 48 is intended to hold the swing out compartment 36 and swing out compartment 37 in the closed position. In other embodiments of the present invention, the swing out compartment 36 and swing out compartment 37 may be held closed by using another mechanical method. Also shown is an indent or cutout at the edge of the lower horizontal surface 22 to accommodate access to the bottom edge of the swing out compartment 36 and swing out compartment 37 for ease of grasping the bottom edge of the swing out compartment 36 and swing out compartment 37 and opening the components to the fully open position. Also shown is an indent or cutout 46 at the edge of the lower horizontal surface 22 to accommodate access to the bottom edge of the drawer compartment 42 for ease of opening the drawer compartment 42 to the fully open position.
Figure 3:
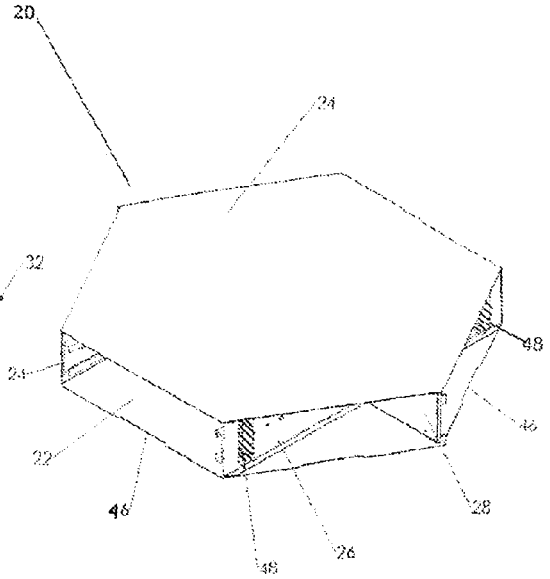
Figure 4:
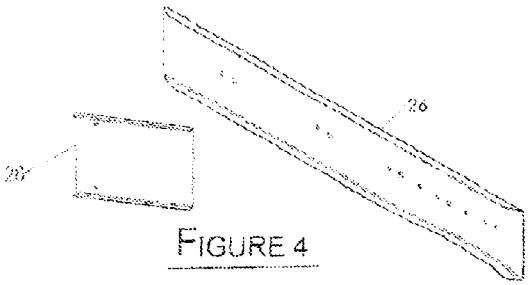
FIG. 4 illustrates an exploded view of a rotatable multilevel tool organizer vertical divider for drawer slides and hinge support
Figure 6:
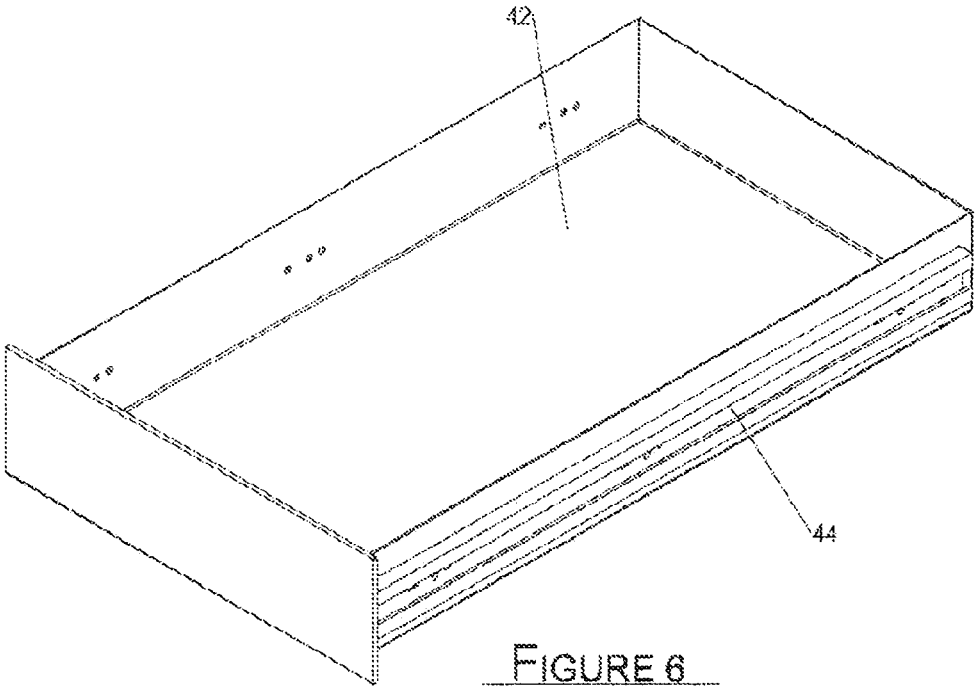
FIG. 6 illustrates an exploded view of a rotatable multilevel tool organizer drawer unit with drawer slides
Figure 8:
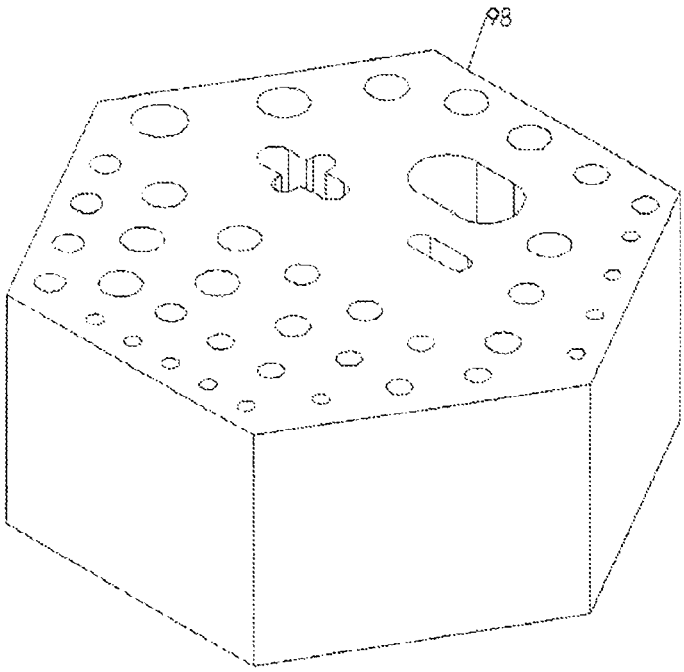
FIG. 8 illustrates an exploded view of a rotatable multilevel tool organizer foam insert for multitier upper unit
Figure 9:
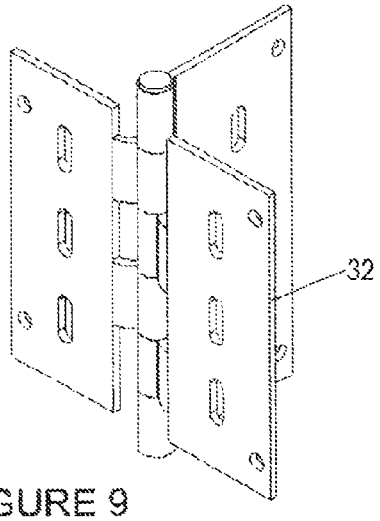
FIG. 9 illustrates an exploded view of a rotatable multilevel tool organizer hinge
Figure 10:
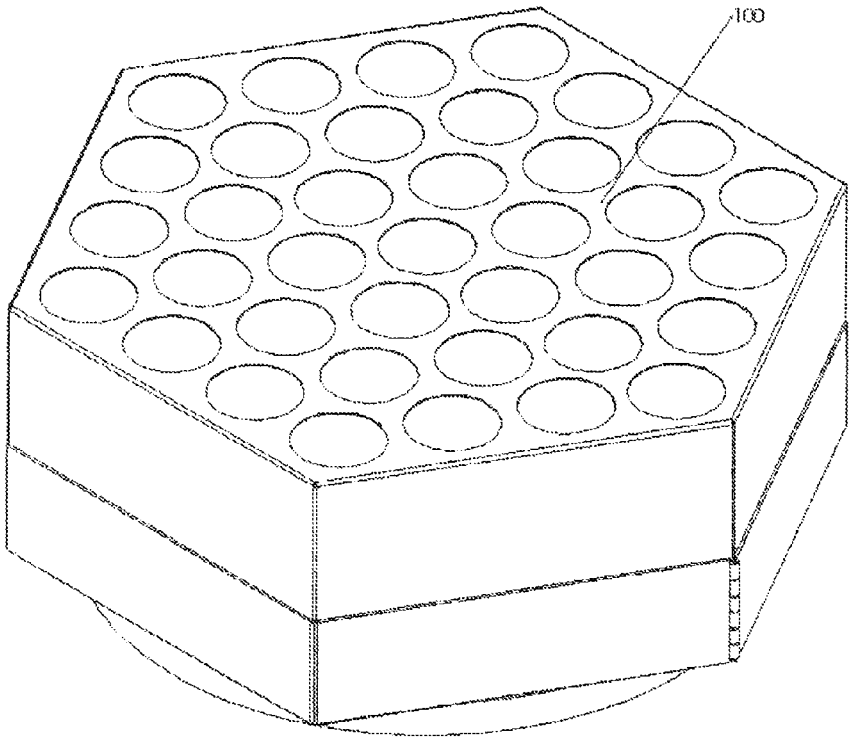
FIG. 10 illustrates a perspective view of a rotatable multilevel tool organizer base unit and multitier upper unit for securing computer numerical control machine tools, without tools Referring to FIG. 1 a perspective view of the rotatable multilevel tool organizer 10 and an elevation view 11 of the present invention not populated with tools is shown. The rotatable multilevel tool organizer 10 is formed of three levels or tiers, of a geometric angular shape with a base or lower unit 20, and a middle or multitier upper unit 70 and resting on a lazy susan bearing type rotating device 56. Located on the upper surface of the base unit 20 are a plurality of cylindrical pieces in a vertical position 50 for storing a plurality of sockets or other similar type tools. The second tier labeled in FIG. 2 as the middle unit 70, rests on the upper horizontal surface 24 of the base unit 20. The middle unit 70 is intended to store mechanic type wrenches, plier type devices and other components. The tools stored in the middle unit 70 are secured in the vertical position by a foam insert 76. Intended to store and organize multiple types of mechanics tools, including screw drivers, hammers, adjustable wrenches, long handle wrenches and other items of similar type, shape or configuration. The multitier upper unit 70 has an upper horizontal surface with a plurality of openings to hold the tools. A foam insert 98 is inserted inside the multitier upper unit 70 with a plurality of openings. The openings of the foam insert 98 are of the same shape and match the horizontal dimensional layout as multitier upper unit 70 horizontal surface. The foam insert 98 is intended to secure the tools in a vertical configuration.

The use of tool organizers or tool storage devices is known in the prior art. Most hold a variety of tools in varying configurations and designs, comprising a variety of chambers, compartments and receiving devises. For example, prior art is described in U.S. Pat. No. 7,717,277 Meinhardt and U.S. Pat. No. 3,489,289. While both are rotatable, they sacrifice tool platform structure by using multiple flat shelves and sloped surfaces for Meinhardt. In another prior art by Scott-Fenton the device includes a significant number of pockets to hold fastening members, parts, washers, screws and nails, but not the ability to hold a significant plurality of tools. Both holders use a generally circular format that sacrifices storage platform organization space. Both holders have a rotatable base or lazy susan type structure. The Scott-Fenton has no drawers and the Meinhardt has only one central drawer.

The present invention departs from the conventional concept of the prior art by providing a more organized method for storing and presenting tools or other components and adding swing out devices for tool or other component storage. The present invention utilized a plurality of vertical cylindrical devices to hold standard sockets. The advantage of this configuration is the physical diameter of the socket is not limited by the size of an opening or hole, as is the case in Meinhardt. The present invention includes a pullout drawer and utilizes all available space including the interior portion of the upper unit, for long handle tools or components, like hammers, tool extensions, socket wrenches, that are stored or rest in the upper unit. It is the object of the present invention to utilize a lazy susan type ball bearing for a 360 degree rotation and full access to all surfaces. It is the object of the present invention such that, it is efficient to use, allowing full access and visibility to all tools, minimizing unused space and can be placed on a standard horizontal surface or on a rolling device for ease of use within the work area. It is the object of the present invention to be easier and more efficient to manufacture than previous art, by utilizing industry standard fabrication practices and industry standard materials, not requiring special materials, tools, methods or skills.

Thus several advantages of the present invention are, the method of storing tools or components in the vertical position through the use of foam inserts and cylindrical pieces. Having the tools or components securely held in place minimizes the possibility of the tools or components falling off the tool organizer during the use. Other advantages of one or more aspects of the present invention are that the rotatable multilevel tool organizer allows for a more variety and types of tools or components of varying sizes to be stored or presented.

The invention claimed is:

1. A rotatable multilevel tool organizer comprising:

(a) a lazy suntan bearing unit, allowing 360 degree rotation of said multilevel tool organizer, (b) a hexagonally shaped lower unit, comprising a horizontal bottom surface and a horizontal top surface with a plurality of dividers of various lengths attached vertically between said bottom and said top surfaces creating a plurality of triangular cavities and a rectangular cavity between said horizontal top and bottom surfaces, whereby each of said plurality of triangular cavities receives one of a plurality of swing out compartments and said rectangular cavity receives a slideable drawer, said bottom surface of said tower unit affixed to said lazy susan bearing unit, (c) a hexagonally shaped multitier upper unit, said multitier upper unit comprising a top tier and a lower tier, said top tier of said upper unit being smaller dimensionally on the horizontal plane than said lower tier of said upper unit, each said tier having at least one horizontal surface, said top tier and said lower tier each having a plurality of vertical surfaces for the support of said at least one horizontal surface, an interface of said horizontal and said vertical surfaces creates a plurality of trapezoidal cavities and a hexagonal cavity, (d) a plurality of projecting pins affixed vertically to a top surface of said lower unit between outer vertical surfaces of said lower tier of said upper unit and an edge of said top surface of said lower unit, in a predetermined pattern for the storage of sockets and tools, (e) a plurality of trapezoidal shaped foam inserts and a hexagonal foam insert such that each of said plurality of trapezoidal cavities of the upper unit receives one of the plurality of trapezoidal foam inserts and said hexagonal cavity of the upper unit receives said hexagonal foam insert.

2. The rotatable multilevel tool organizer as claimed in claim 1, whereby said swing out compartments are attached to said lower unit by a hinge, allowing said swing out compartments to swing horizontally to an open position for access to contents of said swing out compartments.

3. The rotatable multilevel tool organizer as claimed in claim 1, whereby said slideable drawer is attached to said lower unit with two slide, gliders, said slideable drawer able to extend outwardly from said lower unit, providing access to contents of said slideable drawer.

4. The rotatable multilevel tool organizer as claimed in claim 1, whereby, said upper unit being centrally located and affixed to said horizontal top surface of said lower unit, said upper unit having a plurality of openings penetrating through said at least one horizontal surface allowing for storage and presentation of mechanic's tools and other components, in a substantially vertical position.

5. The rotatable multilevel tool organizer as claimed in claim 1, whereby said trapezoidal foam inserts each having different sized slots or openings.

6. The rotatable multilevel tool organizer as claimed in claim 1, whereby said hexagonal foam insert having a plurality of openings, for the storage and presentation of tools in a substantially vertical position.

* * * * *